US008578847B2

(12) United States Patent
Fox et al.

(10) Patent No.: US 8,578,847 B2
(45) Date of Patent: Nov. 12, 2013

(54) APPARATUSES AND METHODS FOR FLUID EVACUATION

(76) Inventors: Matthew A. Fox, Victoria, TX (US); Robert T. Fox, Victoria, TX (US)

( * ) Notice: Subject to any disclaimer, the term of this patent is extended or adjusted under 35 U.S.C. 154(b) by 424 days.

(21) Appl. No.: 12/730,177

(22) Filed: Mar. 23, 2010

(65) Prior Publication Data

US 2010/0239434 A1 Sep. 23, 2010

Related U.S. Application Data

(60) Provisional application No. 61/162,672, filed on Mar. 23, 2009.

(51) Int. Cl.
*B30B 13/00* (2006.01)
*B30B 9/20* (2006.01)

(52) U.S. Cl.
USPC ..... 100/37; 100/100; 100/121; 100/156

(58) Field of Classification Search
USPC ..... 100/35, 37, 76, 155 R, 121, 176, 100, 100/156; 137/355.12, 355.16, 355.19, 137/355.26, 355.27
See application file for complete search history.

(56) References Cited

U.S. PATENT DOCUMENTS

| | | | | |
|---|---|---|---|---|
| 1,537,637 | A * | 5/1925 | Jarvis | 137/355.12 |
| 3,601,038 | A * | 8/1971 | Hayes | 100/100 |
| 3,866,532 | A * | 2/1975 | Ogden, Jr. | 100/171 |
| 4,228,553 | A * | 10/1980 | Genuit | 4/490 |
| 5,388,609 | A * | 2/1995 | Ghio et al. | 137/355.27 |
| H1520 | H * | 3/1996 | Hannula | 100/171 |
| 5,505,404 | A * | 4/1996 | Dubreuil | 242/532.6 |
| 6,135,139 | A | 10/2000 | Blake | |
| 6,591,744 | B2 | 7/2003 | Peek | |
| 7,661,683 | B2 | 2/2010 | Fernandez | |
| 2007/0252363 | A1 | 11/2007 | Fernandez | |
| 2010/0181411 | A1 | 7/2010 | Fernandez | |

* cited by examiner

*Primary Examiner* — Jimmy T Nguyen
(74) *Attorney, Agent, or Firm* — Equip Law Group; Christopher Quan

(57) ABSTRACT

Devices and methods for evacuating fluids from a flexible conduit, particularly to evacuating water from a fire hose. In one aspect, a fluid evacuating apparatus is utilized to evacuate a fluid, such as water, from a flexible conduit, such as, for example, a fire hose. The apparatus may further be utilized to collapse the flexible conduit for storage and/or transport. In exemplary embodiments, a fluid evacuating apparatus may be utilized to evacuate the water from hoses of a wide range of diameters that collapse into a compact form for storage. The apparatus may include a frame with a handle, a mobility mechanism, such as, for example, wheels or rollers, a roller which may evacuate water, and a restraining mechanism which may hold down the hose, such as a roller or rollers.

15 Claims, 4 Drawing Sheets

APPARATUSES AND METHODS FOR FLUID EVACUATION

CROSS-REFERENCE TO RELATED APPLICATIONS

This application claims the benefit of U.S. provisional patent application Ser. No. 61/162,672, filed Mar. 23, 2009, entitled "APPARATUSES AND METHODS FOR FLUID EVACUATION," the entire contents of which are hereby incorporated by reference.

FIELD OF THE INVENTION

The present invention is directed to devices and methods for evacuating fluids from a flexible conduit, particularly to evacuating water from a fire hose.

BACKGROUND OF THE INVENTION

The predominant method of fire fighting/extinguishing is the use of water sprayed onto the fire. Water is typically delivered to the location of the fire through the use of trucks, pumps and hoses. Hoses typically consist of a flexible material with a circular cross-section when pressurized with water and flattens when unpressurized. When the use of the hoses to apply water to the fire is complete, the hoses must be returned to their storage compartments on the fire truck. In order to do this the hoses must first be drained of all the residual water contained within the unpressurized hose so the hose will lay completely flat and compressed so the hose fits back into the designated storage space. The ability to store the hose in a compact efficient way is imperative for next use. The response time of the fire fighters and overall efficiency is directly affected by the ability to eliminate all the water from hoses.

The typical method of draining the hoses requires multiple fire fighters. One or more people secure the end(s) of the hose, and two or more people raise the hose using either a bar or roller lifted to waist height and walking the length of the hose maintaining that height. Alternatively a single person can lift the hose over the shoulder or head and walk the length of the hose using their hands to walk down the hose.

These methods typically require multiple personnel, which may or may not be immediately available depending on the size of the fire department, and risk of injury due to the strain under the weight of the hose filled with water and the requirement of having to walk up to 100 feet under that strain.

SUMMARY OF THE INVENTION

The present invention is directed to devices and methods for evacuating fluids from a flexible conduit, particularly to evacuating water from a fire hose.

In one aspect, a fluid evacuating apparatus is utilized to evacuate a fluid, such as water, from a flexible conduit, such as, for example, a fire hose. The apparatus may further be utilized to collapse the flexible conduit for storage and/or transport.

In exemplary embodiments, a fluid evacuating apparatus may be utilized to evacuate the water from hoses of a wide range of diameters that collapse into a compact form for storage. The apparatus may include a frame with a handle, a mobility mechanism, such as, for example, wheels or rollers, a roller which may evacuate water, and a restraining mechanism which may hold down the hose, such as a roller or rollers. In one embodiment, the restraining mechanism may be a rear roller which may be hinged to the frame such that the roller may, for example, collapse within the frame for storage. This may be useful to minimize the form factor of the apparatus. The water evacuating roller, which may be a centrifugal roller, may be positioned on the frame such that the roller may be at an optimized angle to the hose for evacuation of the water and such that the hose may be prevented from doubling over itself. The rear roller may also be weighted to, for example, provide downward force to the hose. This may be useful to prevent the build up of excess hose (slack in the hose) in front of the evacuating roller. This may also create a pressure head in the hose, which may, for example help prevent residual water from remaining in the hose after passing the apparatus. In some embodiments, the frame may also include a storage mechanism, such as, for example, a spooler for a hose. The apparatus may also include restraining features which may aid in preventing movement of the apparatus, such as, for example, by restraining the mobility mechanism. This may be desirable to, for example, aid in loading a conduit onto the apparatus, or to aid in preventing movement of the apparatus during manipulation of the conduit or storage. The apparatus may also include, for example, a propulsion system. For further example, the apparatus may be motorized or may include an engine. The rollers and/or restraining mechanisms may also be motorized, and/or otherwise powered.

In another aspect, a method of utilizing the fluid evacuating apparatus includes mounting a flexible fluid conduit, such as a hose, to the apparatus such that the hose contacts the evacuating roller and is held higher than at least a portion of the hose. Gravity may thus be employed to evacuate the water from the hose. Further, the hose may be held down to a surface, such as the ground, by the restraining mechanism. The hose may then be spooled and/or otherwise stored or transported. The user may, for example, also step on or around the hose as it passes under the restraining mechanism. The hose may also be spooled or otherwise stored on the fluid evacuating apparatus.

The present invention together with the above and other advantages may best be understood from the following detailed description of the embodiments of the invention illustrated in the drawings.

DETAILED DESCRIPTION OF THE INVENTION

The detailed description set forth below is intended as a description of the presently exemplified device provided in accordance with aspects of the present invention and is not intended to represent the only forms in which the present invention may be practiced or utilized. It is to be understood, however, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described herein can be used in the practice or testing of the invention, the exemplified methods, devices and materials are now described.

In one aspect, a fluid evacuating apparatus is utilized to evacuate a fluid, such as water, from a flexible conduit, such as, for example, a fire hose. The apparatus may further be utilized to collapse the flexible conduit for storage and/or transport.

Figure 1:
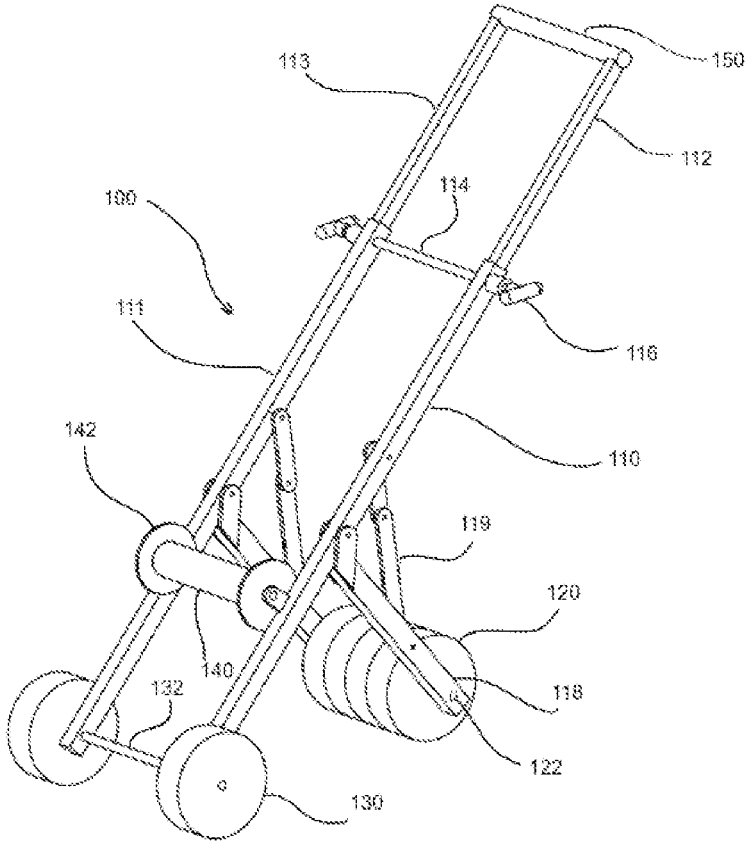
FIG. 1 illustrates a fluid evacuating apparatus in an embodiment of the present invention.

In exemplary embodiments, an example of which is illustrated in FIG. 1, a fluid evacuating apparatus 100 may be utilized to evacuate the water from hoses of a wide range of diameters that collapse into a compact form for storage. The apparatus 100 may include a frame which may include a handle, a mobility mechanism, such as, for example, wheels or rollers, a roller which may evacuate water, and a restraining mechanism which may hold down the hose, such as a roller or rollers. Rollers may generally rotate about an axis, such as an axle or rod.

As illustrated in FIG. 1, the apparatus 100 may include two main rails 110, 111, which may, for example, be mirrors of each other. The rails 110, 111 may further be parallel and in plane, or planar, and may generally comprise the frame of the apparatus 100. The rails 110, 111 may be separated by a spacer or spacers, such as spacers 114, 132 which may, for example, also ensure the parallelism of the rails 110, 111. The cross-section of the rails 110, 111 may be any appropriate shape, such as, for example, square, rectangular, circular, elliptical, irregular, and/or any other appropriate shape.

Figure 1A:
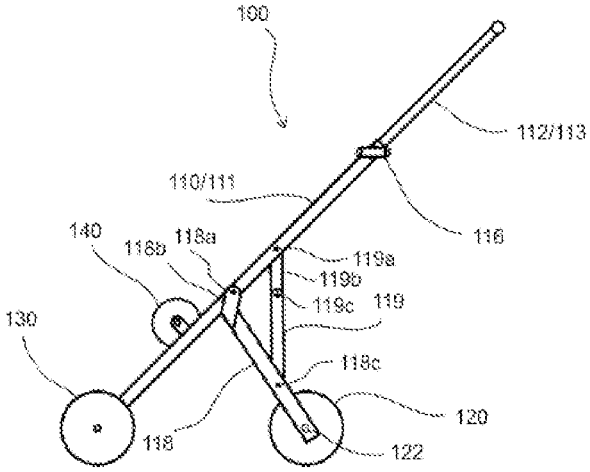
FIGS. 1*a* and 1*b* illustrate collapsing a fluid evacuating apparatus.
Figure 1B:
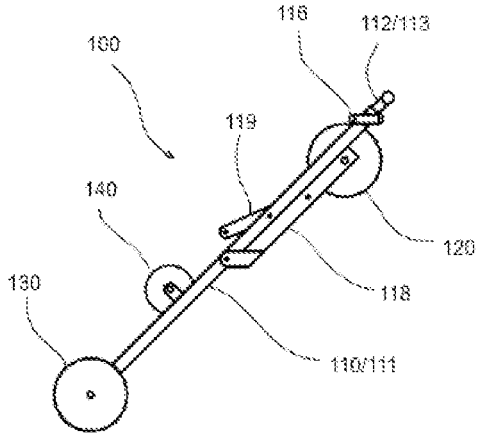

In one embodiment, the restraining mechanism may be a rear roller 120 which may be hinged to the frame, such as via hinged connections 118, 119 to main rails 110, 111, such that the roller 120 may, for example, collapse within the frame for storage. This may be useful to minimize the form factor of the apparatus 100. The apparatus 100 in extended configuration is illustrated in FIG. 1*a* and in a collapsed configuration in FIG. 1*b*, with hinged connections 118, 119 folding the rear roller 120 in between the main rails 110, 111. In an exemplary embodiment, as illustrated in FIG. 1*a*, the rear roller 120 may be mounted on hinged connections 118, 119, which may be connected to the main rails 110, 111 via pins 118*a*, 119*a*, respectively, through the flanges 118*b*, 119*b* on the hinged connections 118, 119. The hinged connection 119 may also be hinged on hinged connection 118 via pins 118*c*. The flanges 119*b* may further be hinged on pins 119*c*. The rear axle 122 may further aid in ensuring the parallelism of the hinged connections 118. The hinged connections 118, 119 may also substantially and reversibly lock in a given position, such as extended in FIG. 1*a* and collapsed in FIG. 1*b*. The rear roller 120 may further include multiple separate components, such as the 4 separate wheels 120*a* as illustrated in FIG. 1 that may rotate independently or alternatively in at least partial unison.

The apparatus 100 may further include a water evacuating roller 140, which may be, for example, a centrifugal roller, and may be positioned on the main rails 110, 111 such that the roller 140 may be at an optimized angle to the hose for evacuation of the water and such that the hose may be prevented from doubling over itself. The roller 140 may further include guiding, directing, confining and/or restraining features, such as the guides 142. Guides 142 may, for example, be utilized to guide a hose on roller 140 and may aid in, for example, preventing slippage of the hose off of the roller 140 or aiding in keeping the hose straight on the roller 140. The guides 142 may further be sized appropriately to accommodate hoses of a given size or size range. The guides 142 may further rotate freely from roller 140 or alternatively they may be fixed rotationally to the roller 140. The position along the axis of the roller 140 of the guides 142 may also be adjustable, such as by quick releases for adjusting and reversibly locking the position of the guides 142 on given positions on the axis of the roller 140. There may also be detents for discrete positions of the guides 142 along the axis.

The rear roller 120 may also be weighted to, for example, provide downward force to the hose. This may be useful to, for example, prevent the build up of excess hose (slack in the hose) in front of the evacuating roller 140. This may also create a pressure head in the hose, which may, for example help prevent residual water from remaining in the hose after passing the apparatus 100. In some embodiments, the frame may also include a storage mechanism, such as, for example, a spooler for a hose.

Figure 2:
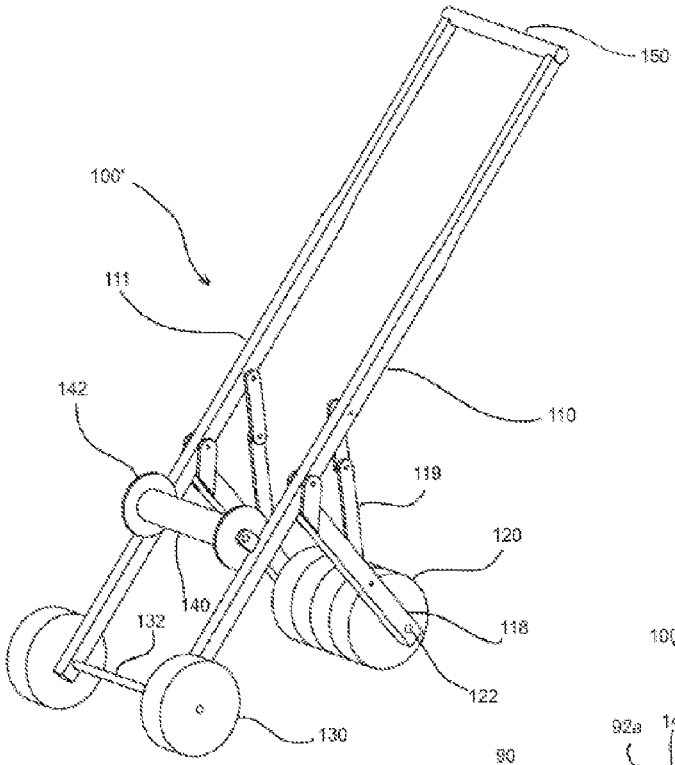
FIG. 2 illustrates an alternative embodiment of a fluid evacuating apparatus in another embodiment of the present invention.

The apparatus 100 may further include a handling or control feature, such as handle 150 as illustrated in FIG. 1. The handle 150 may be mounted on telescoping extensions 112, 113, which may in turn telescopically collapse into and extend from main rails 110, 111, which may be substantially hollow and sized to fit extensions 112, 113. The position of the extensions 112, 113 may be reversibly adjusted by telescoping within the main rails 110, 111 and reversibly locking them in place via a locking mechanism or feature, such as the quick release handles 116 illustrated in FIG. 1. Other locking mechanisms or features may include, but are not limited to, lock bars, compression joints, corresponding locking features, and/or any other appropriate mechanism or feature. The apparatus 100 may also include at least one set of detents or other stops on either the extensions 112, 113, within the rails 110, 111, or both, and may be utilized to customize the handle 150 height and retention in the collapsed position. In another embodiment, a handle 150 may be directly attached to rails 110, 111, such as illustrated with apparatus 100' in FIG. 2.

The apparatus 100 may further include a mobility mechanism, such as, for example, wheels 130 as illustrated in FIG. 1. The wheels 130 may generally spin on an axle, such as, for example, axle 132 which may also be a spacer 132 as described above. The wheels 130 and axle 132 may also be utilized to aid guiding and/or directing a hose in a manner similar to roller 140 and guides 142.

In some embodiments, the apparatus 100 may feature easily removable components, such as, for example, rollers 120, 140 and/or axle 132. This may be useful in mounting a hose onto the apparatus 100 without guiding the hose into the apparatus 100 by one end, such as at some middle point of the hose. The removable components may be remounted on the apparatus 100 around the hose in an appropriate configuration for operation.

In other embodiments, the apparatus 100 may feature components with gaps or breaks, such as, for example, rollers 120, 140 and/or axle 132. This may be useful in mounting a hose onto the apparatus 100 by slipping the hose through the gaps or breaks to mount onto the rollers 120, 140 and/or above the axle 132. The gaps or breaks may also be, for example, accomplished by retracting or telescoping portions of the components, such that a continuous surface for the components may be restored after mounting.

In general, the apparatus and/or any appropriate component of the apparatus may be motorized and/or otherwise powered. This may be desirable as it may aid in the operation and usage of the apparatus. For example, the apparatus may be motorized and/or equipped with an engine such that it may be, for example, self-propelled. Particular components may also be powered, such as, for further example, the rollers 120, 140.

Figure 3:
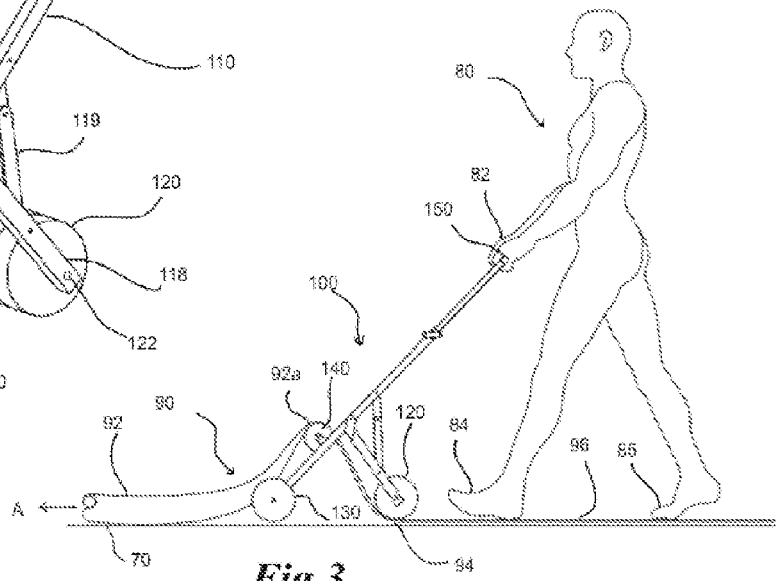
FIGS. 3 and 3*a* illustrates a method of use for a fluid evacuating apparatus of the present invention.

In another aspect, a method of utilizing the fluid evacuating apparatus 100 is illustrated in FIG. 3. The method includes mounting a flexible fluid conduit 90, such as a hose, to the apparatus 100 such that the hose 90 contacts the evacuating roller 140, shown at point 92*a*, and is held higher than at least a portion of the hose 92. Gravity may thus be employed to evacuate the water A from the hose 90. Further, the hose 90 may be held down to a surface 70, such as the ground, by the restraining mechanism 120, such as at point 94, which may be substantially evacuated of fluid. The restraining mechanism 120 may, for example, apply force to the hose 90 such that it may compress, which may, for example, decrease the internal cross-sectional area of the hose 90 (i.e. pinch the hose 90). This may be desirable as pinching may generally aid in preventing fluid from remaining in the hose 90 after passing the restraining mechanism 120. This may also generally increase the pressure in the hose 90, which may, for example, aid in evacuating fluid. In general, the apparatus 100 may be advanced along the length of the hose 90, in a direction from a substantially evacuated end, such as portion 96, to a substantially un-evacuated end, such as portion 92. The hose 90 may then be spooled and/or otherwise stored or transported. The user 80 may hold the apparatus by hands 82 on the handle 150 and, for example, also step on or around 84, 85 the hose 90, such as at point 96, as it passes under the restraining mechanism 120. The hose 90 may also be spooled or otherwise stored on the fluid evacuating apparatus 100.

Figure 3A:
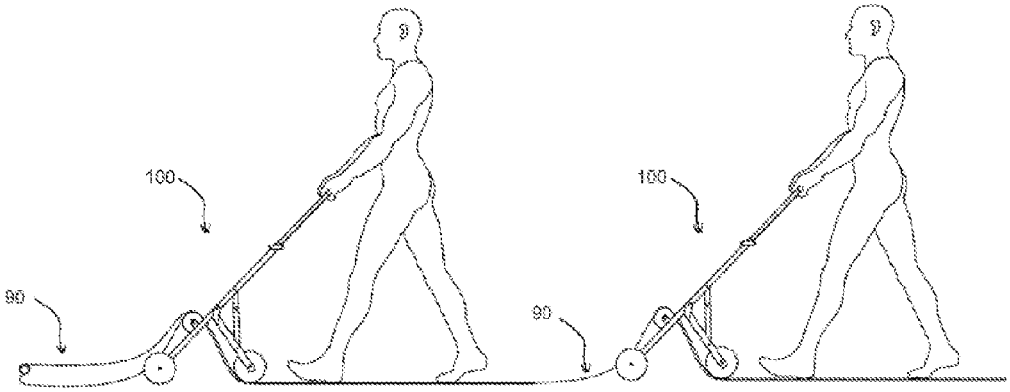

In an alternative embodiment, multiple apparatuses 100 may be utilized on the same length of conduit such that any fluid not evacuated by the first apparatus 100 may be followed up on with at least a second apparatus 100, as illustrated in FIG. 3*a*.

In general, the hose 90 may be held in at least some tension along its axis. This may be desirable, for example, to aid in preventing bunching up of the hose 90 during evacuation.

Figure 4:
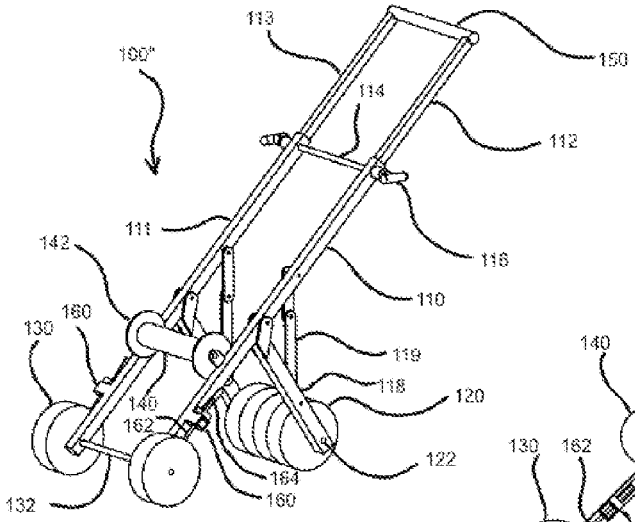
FIGS. 4, 4*a*, 4*b*, 4*c*, 4*d*, and 4*e* illustrate another embodiment of the fluid evacuating apparatus of the present invention.
Figure 4A:
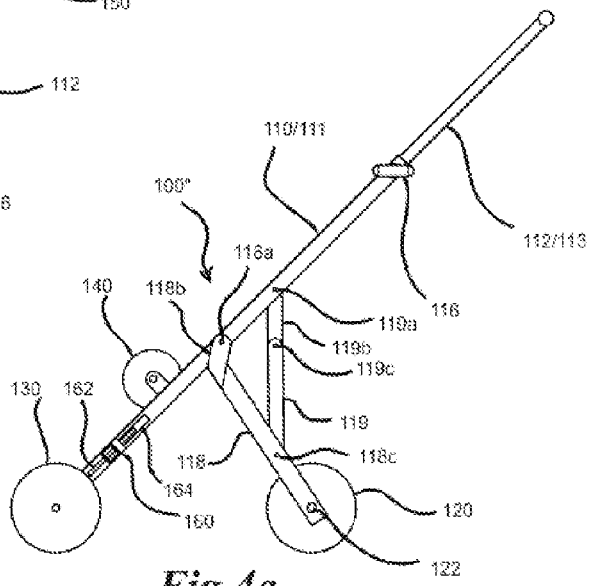
Figure 4B:
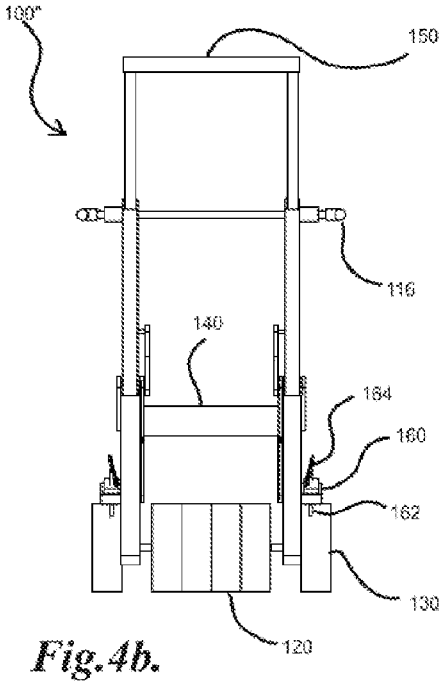
Figure 4C:
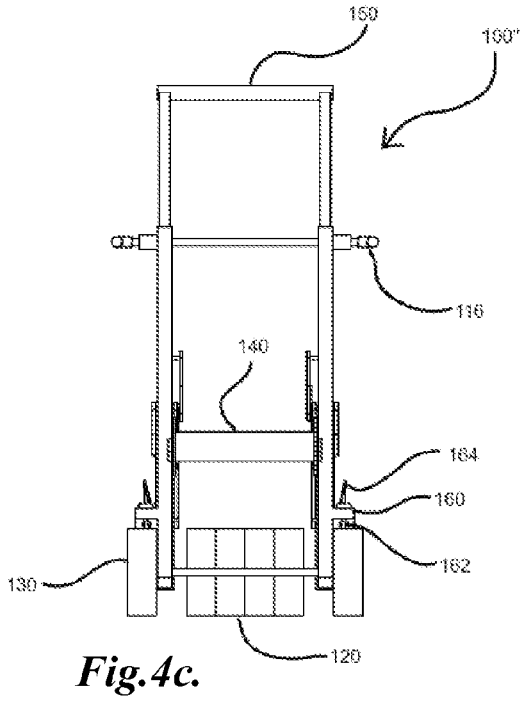
Figure 4D:
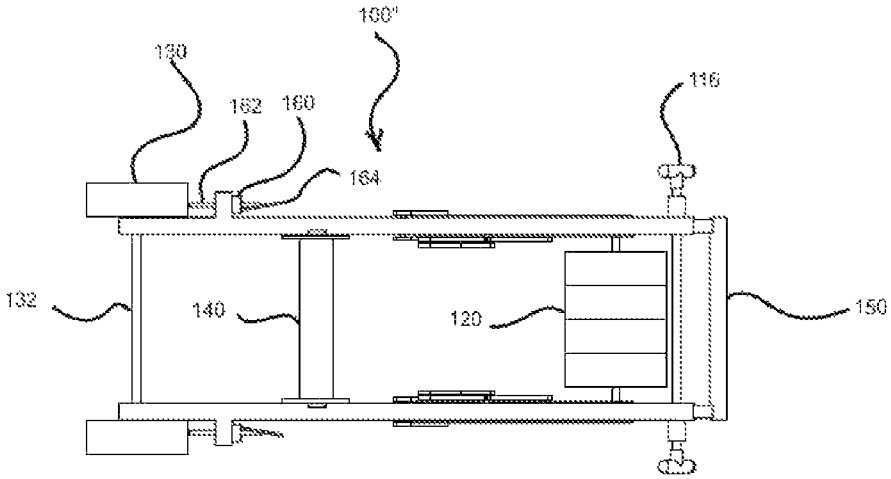
Figure 4E:
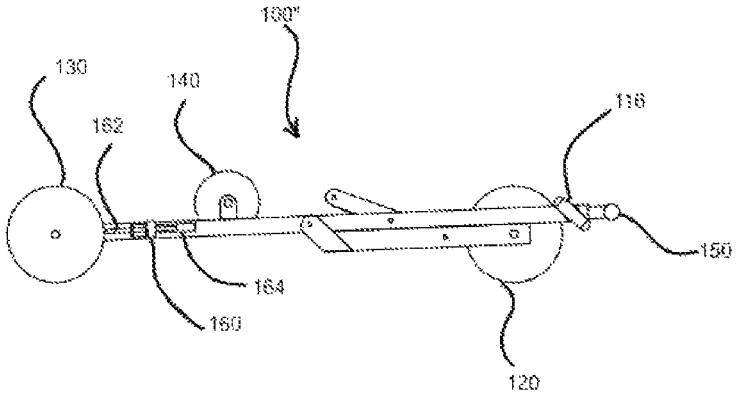

In some embodiments, a fluid evacuating apparatus may include features which may aid in mounting of a conduit on the apparatus. For example, a fluid evacuating apparatus 100", which may be substantially the same or similar to the apparatus 100 or 100' as discussed above, may additionally incorporate restraining features 160 which may be utilized to at least partially restrain the movement of the apparatus 100" by, for example, restraining the rotation of wheels 130, as illustrated in perspective view of FIG. 4, side view of FIG. 4*a*, rear view of FIG. 4*b*, front view of FIG. 4*c*, collapsed top view of FIG. 4*d*, and collapsed side view of FIG. 4*e*. Restraining features 160 may, for example, be restraining brakes, rotational locking features, and/or any other appropriate restraining feature or combination thereof. Restraining brakes may, for example, include, but are not limited to, roller friction brakes, disc brakes, drum brakes, rim brakes, and/or any other appropriate type of brake or combination thereof. As illustrated, a restraining feature 160 may include a restraining post 162 which may substantially contact the wheel 130 such that it may impair or otherwise aid in preventing rotation of wheel 130. The restraining feature 160 may also include control levers 164 which may be utilized to actuate the restraining post 162 between in contact with wheel 130 and not in contact. The pressure applied by the post 162 on the wheel 130 may further be adjustable. The restraining feature 160 may then generally aid in keeping the apparatus 100" stationary during loading of a conduit and, for example, when manipulating a conduit while it is loaded in the apparatus 100". The restraining feature 160 may also be utilized to aid in preventing movement of the apparatus 100" during storage, such as when the apparatus 100" is collapsed in FIGS. 4*d* and 4*e*. For example, the apparatus 100" may be stored on a vehicle or other moving object and the restraining feature 160 may be employed to aid in preventing movement of the apparatus 100" relative to the storage surroundings.

The invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes to the claims that come within the meaning and range of equivalency of the claims are to be embraced within their scope. Further, all published documents, patents, and applications mentioned herein are hereby incorporated by reference, as if presented in their entirety.

The invention claimed is:

1. An apparatus for evacuating fluid from a flexible conduit on a surface, said apparatus comprising:

a frame having a handle;

an evacuating roller mounted on said frame for contacting and evacuating fluid from said flexible conduit;

a restraining roller mounted on said frame for restraining said flexible conduit against said surface to pinch said flexible conduit on said surface to aid in evacuating fluid from said flexible conduit, wherein said surface is separate from said apparatus; and a mobility feature mounted on said frame for moving said apparatus on said surface;

wherein said evacuating roller is mounted on said frame such that the evacuating roller is higher in a gravitational field than said restraining roller and said mobility feature.

2. The apparatus of claim 1, wherein said restraining roller is substantially weighted.

3. The apparatus of claim 1, wherein said mobility feature comprises at least one wheel mounted on an axle.

4. The apparatus of claim 1, wherein said handle is mounted telescopically to said frame.

5. The apparatus of claim 1, wherein said restraining roller is mounted via a collapsible mechanism to said frame.

6. The apparatus of claim 1, further comprising conduit guides mounted on said evacuating roller.

7. The apparatus of claim 1, wherein said surface is the ground.

8. The apparatus of claim 3, further comprising a restraining feature, wherein said restraining feature reversibly restrains the mobility feature.

9. A method for evacuating fluid from a flexible conduit on a surface comprising:

mounting said flexible conduit to an apparatus comprising:

a frame having a handle;

an evacuating roller mounted on said frame for contacting and evacuating fluid from said flexible conduit;

a restraining roller mounted on said frame for restraining said flexible conduit against said surface to pinch said flexible conduit on said surface to aid in evacuating fluid from said flexible conduit, wherein said surface is separate from said apparatus; and a mobility feature mounted on said frame for moving said apparatus on said surface, wherein said evacuating roller is mounted on said frame such that said evacuating roller is higher in a gravitational field than said restraining roller and said mobility feature, placing said flexible conduit over said evacuating roller to contact a surface of said evacuating roller such that a portion of the flexible conduit contacting said evacuating roller is higher in a gravitational field than another portion of the flexible conduit to evacuate fluid from said flexible conduit; and restraining said flexible conduit against said surface by said restraining roller to pinch said flexible conduit on said surface to aid in evacuating fluid from said flexible conduit while said mobility feature supports said apparatus on said surface.

10. The method of claim 9, wherein said surface is the ground.

11. The method of claim 9, further comprising advancing said apparatus along the axis of said flexible conduit.

12. The method of claim 11, wherein said advancing is from a substantially evacuated end of said flexible conduit to a substantially un-evacuated end.

13. The method of claim 11, further comprising mounting said flexible conduit to a second of said apparatus and advancing both said apparatuses along the axis of said flexible conduit.

14. The method of claim 9, further comprising spooling said flexible conduit after evacuating said fluid.

15. The method of claim 9, further comprising holding said flexible conduit in tension.

* * * * *